US007441595B2

(12) United States Patent
Jelsma

(10) Patent No.: US 7,441,595 B2
(45) Date of Patent: Oct. 28, 2008

(54) METHOD AND APPARATUS FOR SINGLE-RUN FORMATION OF MULTIPLE LATERAL PASSAGES FROM A WELLBORE

(76) Inventor: Henk H. Jelsma, 17835 Kuykendahl, #208, Spring, TX (US) 77379

( * ) Notice: Subject to any disclaimer, the term of this patent is extended or adjusted under 35 U.S.C. 154(b) by 167 days.

(21) Appl. No.: 11/348,749

(22) Filed: Feb. 7, 2006

(65) Prior Publication Data

US 2007/0181308 A1 Aug. 9, 2007

(51) Int. Cl.
*E21B 43/114* (2006.01)
*E21B 47/10* (2006.01)
*E21B 43/26* (2006.01)

(52) U.S. Cl. ..... 166/117.7; 166/255.2; 166/296; 166/308.1; 166/55; 166/177.5

(58) Field of Classification Search ..... 166/242.6, 166/117.7, 255.2, 297, 298, 308.1, 307, 55.1, 166/55, 177.5, 373, 386; 175/4.51, 4.52
See application file for complete search history.

(56) References Cited

U.S. PATENT DOCUMENTS 3,154,147 A * 10/1964 Lanmon, II ..... 175/4.51
3,294,163 A * 12/1966 Lebourg ..... 166/255.2
4,880,067 A 11/1989 Jelsma
4,928,767 A 5/1990 Jelsma
RE33,660 E 8/1991 Jelsma
5,413,184 A 5/1995 Landers
5,853,056 A 12/1998 Landers
6,125,949 A 10/2000 Landers
6,168,213 B1 * 1/2001 Muller ..... 285/391
6,263,984 B1 7/2001 Buckman
6,298,915 B1 * 10/2001 George ..... 166/255.2
6,668,948 B2 12/2003 Buckman

* cited by examiner

*Primary Examiner*—Kenneth Thompson
(74) *Attorney, Agent, or Firm*—James L. Jackson

(57) ABSTRACT

A method and apparatus for forming multiple lateral passages from a wellbore into a subsurface earth formation to facilitate enhancement of the production of oil, gas, heavy oil or minerals from the formation. A plurality of lateral passages are formed from a wellbore into a subsurface formation through the use of a single-run passage forming tool to minimize rig time and associated costs. A downhole indexing tool is positioned downhole and has indexing sections for positioning and indexing of a downhole well service tool and establishes precise radial orientation and location of the tool for its well servicing operation. Sequential unidirectional rotational indexing is accomplished by an indexing control stinger having a J-slot indexing system defining a circumferential slot section defining a desired number of indexing positions that are sequenced responsive to linear reciprocating movement of the indexing control stinger.

19 Claims, 6 Drawing Sheets

METHOD AND APPARATUS FOR SINGLE-RUN FORMATION OF MULTIPLE LATERAL PASSAGES FROM A WELLBORE

The present invention relates generally to the formation of lateral passages from a wellbore into a subsurface earth formation to facilitate enhancement of the production of material such as oil, natural gas or minerals from the formation. More particularly, the present invention concerns a method and apparatus for forming a plurality of lateral passages from a wellbore into a subsurface formation through the use of a single-run passage forming tool. Even more particularly, the present invention involves the use of a downhole tool having an indexing capability to establish precise radial orientation and vertical location of lateral passages that are formed into a subsurface formation from a wellbore.

DESCRIPTION OF THE PRIOR ART

The terms "lateral passages or lateral bores", as used herein, is employed to describe a plurality of lateral passages that extend from a wellbore into a subsurface earth formation of interest. It is not intended that this term be restricted solely to a rotary boring or drilling operation. Rather, it is intended that the terms "lateral or radial bores" and "lateral or radial passages" be considered synonymous. The term "bore" is intended to encompass any method of forming a passage in an earth formation extending laterally or radially from a wellbore. For example, lateral or radial passages are presently formed in subsurface earth formation by hydraulic jet blasting, radial drilling, such as by using a drilling system powered by a hydraulic motor. The terms "lateral" or "radial" are intended to identify passages that extend from a wellbore into an earth formation whether they are oriented in normal relation with the wellbore or extend upwardly or downwardly in relation to their intersection with the wellbore.

For the production of fluid, such as crude oil or minerals from wells intersecting subsurface production formations, the formation of multilateral passages from a main or principal, typically vertical wellbore has been accomplished by rotary drilling or reaming as set forth in U.S. Pat. Nos. 4,880,067, 4,928,767 and RE. 33,660 of Jelsma, or by hydraulic jet blasting as set forth in U.S. Pat. Nos. 5,853,056 and 6,125,949 of Landers and U.S. Pat. Nos. 6,263,948 and 6,668,948 of Buckman et al. Other related inventions from the standpoint of radial or lateral formation of passages extending from a primary well are presented by U.S. Pat. Nos. 4,497,381, 4,527,639 and 4,787,465 of Dickenson et al, U.S. Pat. Nos. 4,640,362, 4,765,173 and 4,790,384 of Schellstede et al.

Though the prior art includes a number of devices and methods for forming lateral passages in a subsurface production formation, the lateral passages are typically formed individually, each lateral passage typically requires an individual run of one or more tools for forming openings or windows in the casing, milling away one or more sections of casing and for forming multiple lateral passages. Thus, for a well having multiple lateral passages it has been necessary to run window cutting and passage forming tools into the well a number of times, i.e., once for each lateral passage. This of course minimizes the productivity of the lateral passage forming procedure and adds significantly to the cost of forming multiple lateral passages from wells. No systems are currently known that permit a number of lateral passages to be formed in a subsurface formation from a wellbore by running a lateral passage forming tool into a well only one time. It is desired therefore to provide a lateral passage forming system that has the capability of being run into a well one time and being actuated to form any desired number of lateral passages, without having to retrieve and re-run the lateral passage forming system between each passage forming procedure.

The term "lateral bores", as used herein, is employed to describe a plurality of lateral passages that extend from a wellbore into a subsurface earth formation of interest. It is not intended that this term be restricted solely to a rotary boring or drilling operation. Rather, it is intended that the terms "lateral or radial bores" and "lateral or radial passages" be considered synonymous. The term "bore" is intended to encompass any method of forming a passage in an earth formation extending laterally or radially from a wellbore. For example, lateral or radial passages are presently formed in subsurface earth formations by radial drilling, motor drilling, such as maybe powered by a hydraulically energized rotary motor, or by hydraulic means such as hydraulic jet blasting. The terms "lateral" or "radial" are intended to identify passages that extend from a wellbore into an earth formation whether they are oriented in normal relation with the wellbore or extend upwardly or downwardly into the formation in relation to their intersection with or extension from the wellbore. The term "fluid" as used herein is intended to mean any liquid, vapor, steam, gas, chemical leaching agent or combination thereof that causes liberation of heavy oil or a mineral from a subsurface formation as a production fluid and prepares or stimulates it for transportation to the surface.

When lateral passages are formed in a subsurface formation, it is difficult to ensure desired orientation of each of an array of multiple lateral passages. Thus, when lateral passages are formed it is possible for them to be improperly oriented with respect to their desired location within the formation. When the wellbore from which the lateral passages are intended is located near an edge portion of the subsurface formation it is possible for one or more of the passages to be located in a non-productive part of the formation.

SUMMARY OF THE INVENTION

It is a principle feature of the present invention to provide a novel type multilateral passage forming method and apparatus wherein some or all of a plurality of lateral passages can be formed from a single wellbore or cased well during a single run of an indexing type passage forming tool.

It is another feature of the present invention to provide a novel type multilateral passage forming method and apparatus that enables selective angular and vertical indexing in the downhole environment thus enabling lateral passages to be formed from a will and extended into a formation of interest without having to remove the passage forming tool from the well until a desired number of lateral passages have been formed.

It is also a feature of the present invention to provide a novel type multilateral passage forming method and apparatus that provides for simple and efficient accurate alignment of multiple lateral passages that extend into a subsurface formation of interest.

It is another feature of the present invention to provide a novel type multiple lateral passage forming method and apparatus having a tool indexing system.

It is a feature of the present invention to provide a novel type multilateral passage forming method and apparatus that provides a lateral passage forming system with the capability of being run into a well one time and being actuated to form any desired number of lateral passages, without having to retrieve and re-run the lateral passage forming system between each passage forming procedure.

It is another feature of the present invention to provide a novel type multilateral passage forming method and apparatus for multiple lateral passage formation from a primary wellbore wherein the multiple lateral passages can be precisely angularly oriented according to a desired plan.

It is also a feature of the present invention to provide a novel type multilateral passage forming method and apparatus having an indexing capability thus permitting the tool to be initially oriented and set according to a desired azimuth and permitting precise indexing of the tool either rotationally, linearly or both between lateral passage forming operations so that each of the lateral passages of the resulting array of lateral passages is precisely oriented according to a desired plan.

Briefly, the various objects and features of the present invention are realized through the provision of an indexing mechanism which is capable of being set within a wellbore or casing. The indexing mechanism incorporates a lower section in the form of an orienting or setting tool which is set at the bottom of a wellbore or is set on a packer which is positioned at a selected location within a wellbore or casing. The indexing mechanism incorporates an upper section in the form of an indexing deflector body. The orienting or setting tool and indexing deflector body each define an annular array of indexing teeth or other suitable indexing geometry that establish engagement with one another to define a plurality of specific angular indexing positions, there typically being four or eight indexing positions throughout the 360° circumference of rotational movement of the setting tool. If desired, the indexing mechanism may be designed to achieve the formation of lateral passages that may have other desired angles of relative rotational positioning. This feature permits a plurality of lateral passages to be formed in a subsurface formation at in equally angularly spaced relation to one another. The indexing mechanism provides indexing control for a casing window or opening forming tool thus permitting a plurality of windows or openings to be cut or otherwise formed in the casing at predetermined locations for lateral passages.

The indexing mechanism provides for support and indexing control for a lateral passage forming tool which may be a hydro-motor driven rotary drill bit for drilling the lateral passages or a hydro-blasting or jetting tool for lateral passage forming by means of a hydro-blasting operation. The indexing mechanism incorporates an accurate reference which permits the indexing tool to be accurately positioned within a well. By accurate positioning of the indexing mechanism and with incremental indexing due to the geometry and dimension of the annular arrays of indexing teeth, all of the radial or laterally extending passages may be accurately oriented. This feature is especially valuable when the primary wellbore is located near the outer edge of a production formation.

A linear indexing mechanism may also be coupled with the rotational indexing tool, thus permitting selective linear indexing of the lateral passage forming tool within the wellbore or casing so that various lateral passages may be spaced along a section of the wellbore or casing and may be rotationally positioned for accurate positioning of the lateral passages. Thus the indexing mechanism of the present invention provides for linear as well as rotational indexing of a well service tool, such as for forming lateral passages in a subsurface formation at selected locations along an interval of the wellbore and for rotationally orienting the lateral passages with respect to a selected azimuth. A lateral passage forming operation may be conducted by running the indexing mechanism into a well with a passage forming tool in assembly therewith. After each lateral passage is completed, the indexing mechanism is actuated to separate the indexing teeth, thus permitting relative rotational movement of the indexing deflector body and setting tool. When rough rotational adjustment has been accomplished the annular arrays of indexing teeth are moved into intimate engagement, thus causing the engaging arrays of indexing teeth to establish precision location of the lateral passage forming tool. After all of the lateral passages have been formed, the indexing mechanism and lateral passage forming tool are retrieved from the well.

Most importantly, the present invention permits the formation of a plurality of lateral passages or casing openings without having to retrieve a cutting and jetting tool from the wellbore between each lateral passage forming operation.

BRIEF DESCRIPTION OF THE DRAWINGS

So that the manner in which the above recited features, advantages and objects of the present invention are attained and can be understood in detail, a more particular description of the invention, briefly summarized above, maybe had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a sectional view illustrating a well extending from the surface to the depth of a subsurface production formation and showing lateral passages extending laterally from the wellbore or casing to a desired distance within the subsurface production formation;

FIG. 2 is a plan view showing a plurality of lateral passages extending from a well into a subsurface formation and being oriented at substantially 90° angles from one another;

FIG. 3 is an exploded elevational view of an indexing mechanism that is constructed according to the principles of the present invention and represents the preferred embodiment;

FIG. 4 is an exploded elevational view of an indexing mechanism that represents an alternative embodiment of the present invention;

FIG. 5 is a plan view taken along line 5-5 of FIG. 4;

FIG. 6 is an elevational view showing an indexing deflector body providing an annular array of indexing teeth;

FIG. 7 is a plan view taken along line 7-7 of FIG. 6, showing the geometry and orientation of the annular array of indexing teeth;

Figure 3:
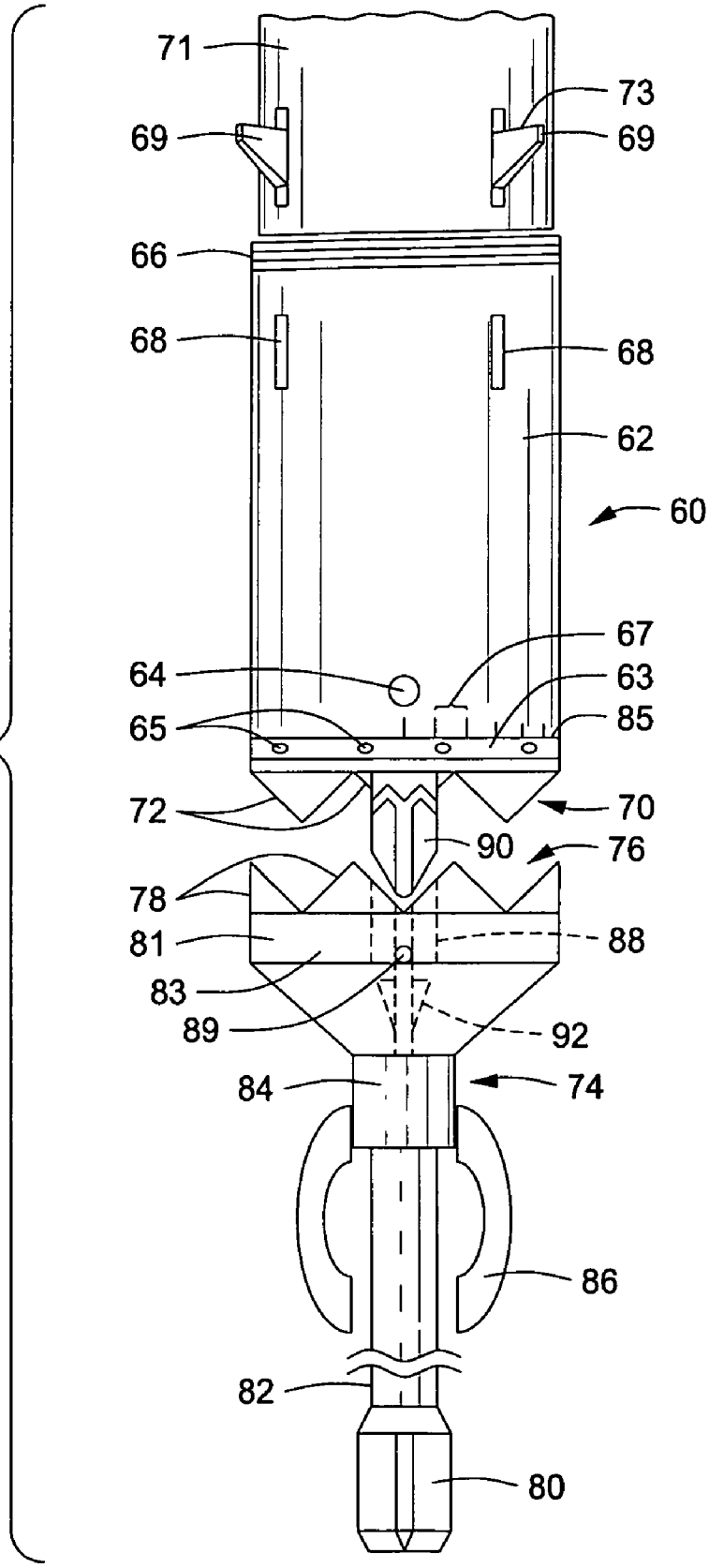
Figure 8:
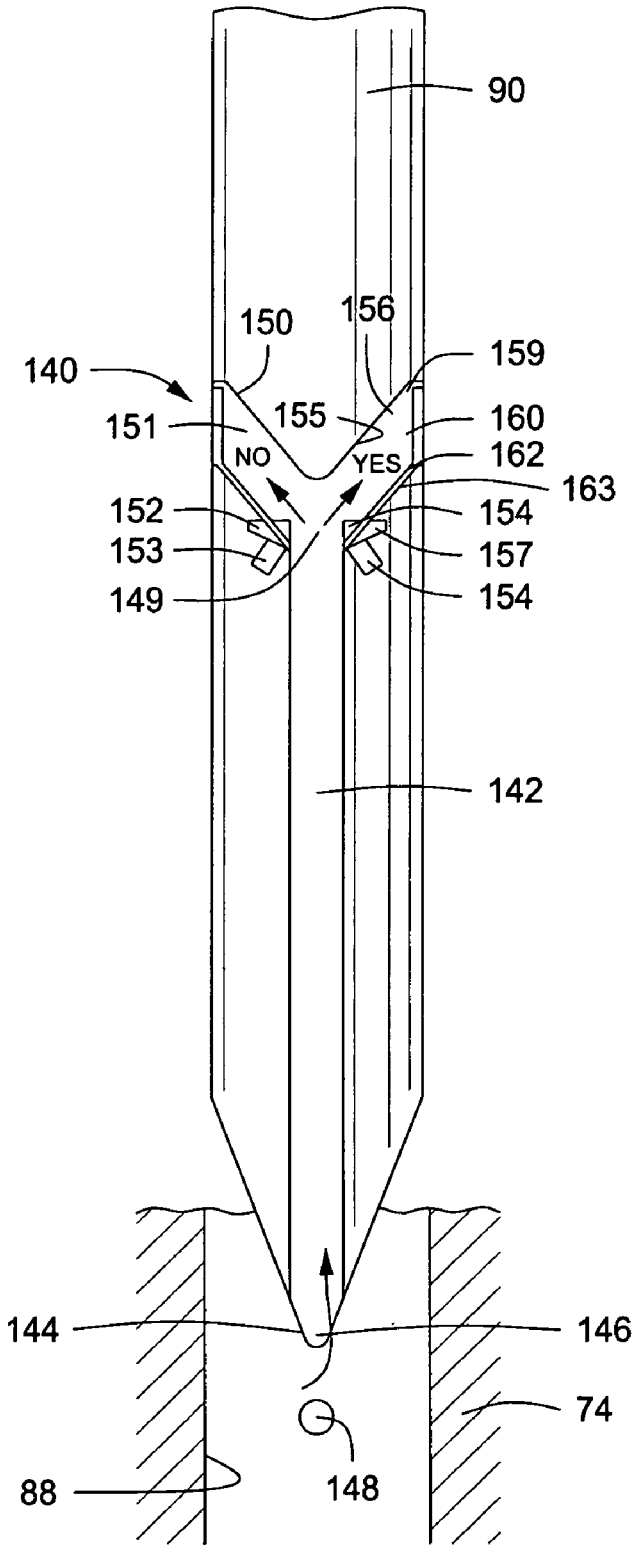
Figure 9:
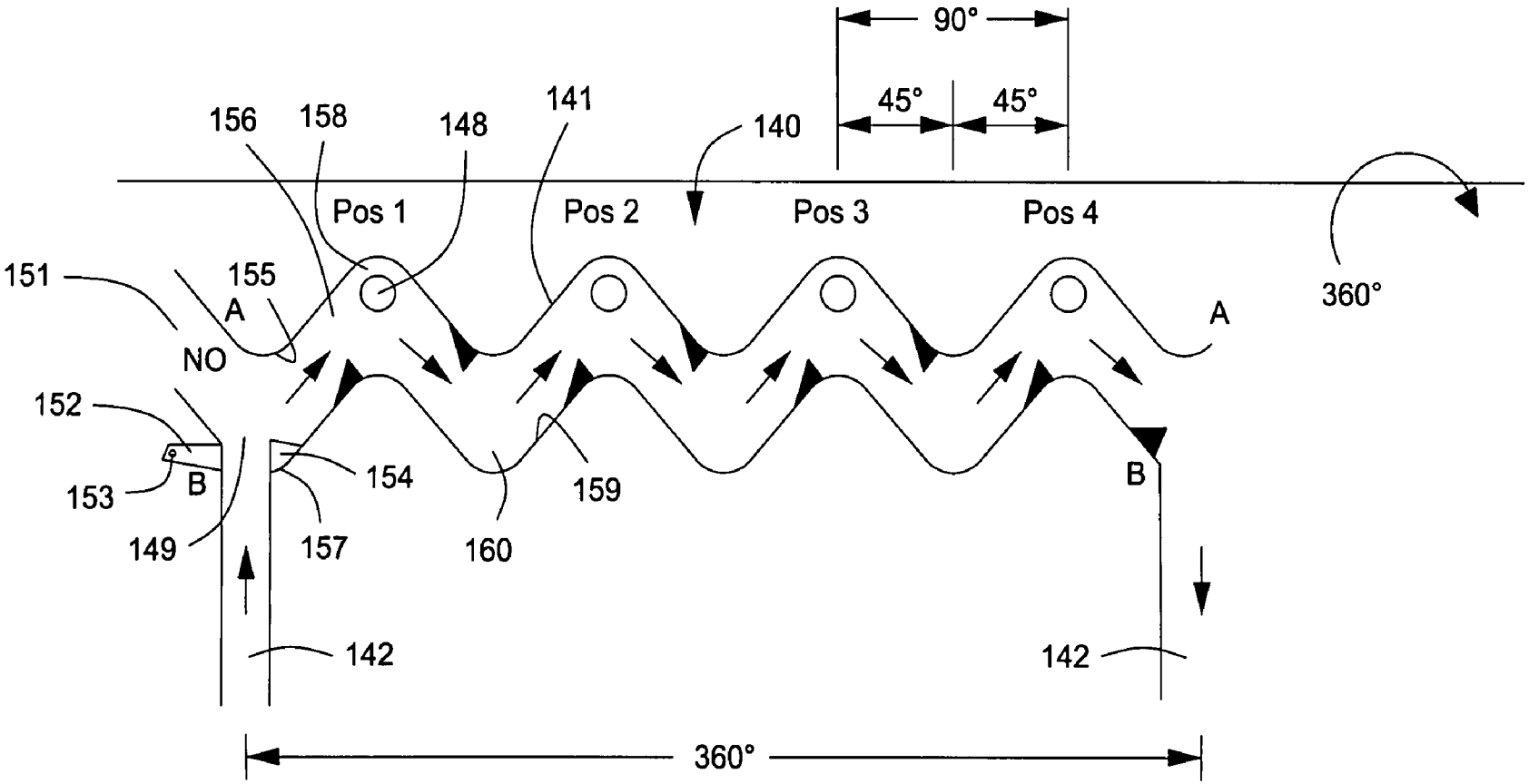

FIG. 8 is a partial elevational view showing the indexing control stinger of FIG. 3 and further showing a indexing slot arrangement of the indexing control stinger for controlling incremental rotational positioning of a casing opening forming tool or a lateral bore forming tool; and FIG. 9 is a flat layout illustration showing a indexing slot arrangement of the indexing control stinger of FIG. 8, being arranges for 90° incremental rotational positioning of well service tools;

DETAILED DESCRIPTION OF PREFERRED EMBODIMENT

Figure 1:
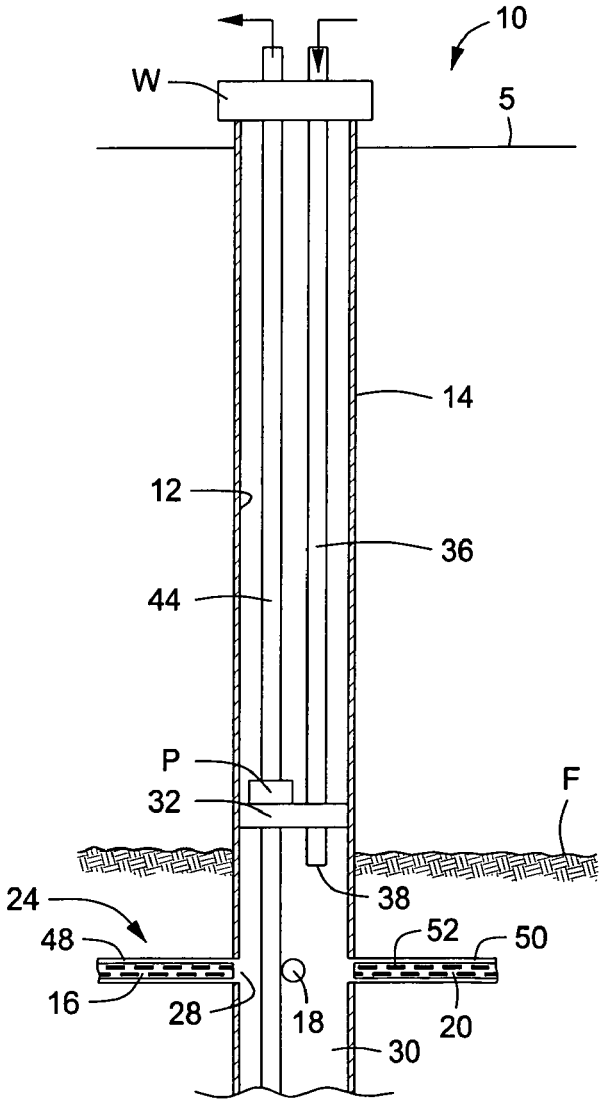
Figure 2:
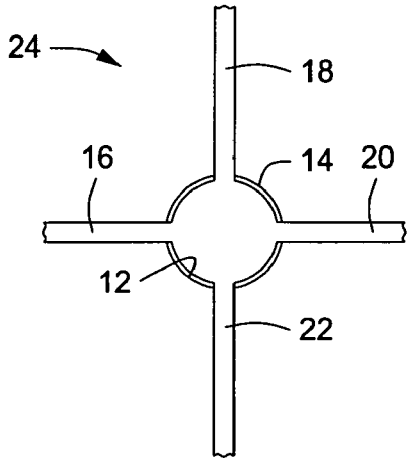

Referring now to the drawings and first to FIGS. 1 and 2, the sectional view shows a well generally at 10 which extends from the surface of the earth "S" to a subsurface formation of interest "F", which is also referred to herein as a production formation from which a material contained therein is intended to be produced. The material to be produced may be crude oil, gas and particularly heavy viscous crude oil that requires steam heating to reduce its viscosity and enable it to migrate or be forced through the production formation for production. The material to be produced may also be a mineral that may be released from the production formation by chemical leaching or released from the formation and otherwise prepared for production by any other suitable means. The well may simply be in the form of an open-hole wellbore 12 or the wellbore may be lined with a casing 14 that extends from the wellhead "W" at the surface "S" to or beyond the depth of the production formation "F" of interest.

For production of heavy viscous oil or minerals it is often desirable to form one or more passages that extend laterally from the well to a desired distance within the formation. As shown in FIGS. 1 and 2, a plurality of lateral passages 16, 18, 20 and 22 are shown to have been formed within the formation from the well and define an upper array of lateral passages. The lateral passages may extend radially from the well as shown in FIG. 2 or they may be angulated upwardly or downwardly from their intersection with the wellbore. As is also evident from FIGS. 1 and 2, an array of lateral passages is shown generally at 24, having a plurality of lateral passages that are formed within the formation "F" from the wellbore 12. It should be borne in mind that a well may have more than one array of lateral passages, such as an array for injection of a fluid medium such as a liquid or a gas into the formation to provide stimulus for migration of the formation fluid through the formation and an array for production of fluid from the formation. The injected fluid medium may also take the form of a vapor, such as steam which accomplishes heating of the formation fluid, particularly heavy viscous crude oil and accomplishes pressurization of the formation to enhance migration of the production fluid within the formation. The arrays of lateral passages may be located in spaced relation such as when an injection array and a production array are employed for collection and production of the formation fluid. Two or more arrays of radiating lateral passages may also be provided in a well for collection of production fluid from a fairly thick production formation or from spaced production formation layers that are intersected by a wellbore.

For production of heavy viscous crude oil from a subsurface formation an injection array of lateral passages will typically be located below a production array. For production of minerals from a formation an injection array of lateral passages will typically be located above the production array. Also, for production of minerals from a formation a plurality of collection laterals and headers can be drilled or otherwise formed laterally through the formation to provide for collection of a production fluid containing residual leaching agent and leached minerals. The collected mineral containing production fluid can be produced by pumping it from the headers of the collection laterals.

The arrays of injection and/or production passages typically extend from openings or windows, such as shown at 28 that are cut, milled or otherwise formed in the well casing or in the alternative may extend from an open hole or from the wellbore where a section of the well casing has been removed, such as by a casing milling operation. The lateral passages are in communication with an injection or production compartment 30 within the well which is typically isolated from other sections of the well by packers such as shown at 32. If the compartment 30 is an injection compartment an injection conduit 36 extends from the surface through the wellbore or casing and extending through the packer 32 and is in communication with the injection compartment 30 via the lower open end 38 of the conduit.

Other packers typically cooperate with the casing, injection tubing and production tubing define a production chamber or compartment which is in communication with the arrays of lateral passages 24 and isolate the production chamber or compartment from other sections of the well. Typically a production conduit 44 extends through the wellbore or casing from the surface and extends through the packer32 and may extend through other packers as well. However, it is only to be borne in mind that the present invention is applicable to many different types of well production and injection systems in that is provides an efficient system for cutting or forming casing openings or windows and for the formation of lateral bores that extend from a primary wellbore. Typically a pump "P" of any suitable character will be mounted to the production conduit and will be operative to pump collected production fluid from the production chamber or compartment to the surface and to typical production fluid handling equipment for treatment and handling of the production fluid. The pump "P" may comprise any one of a number of suitable downhole pump systems that are energized a pump jack, by electric or hydraulic power or by any other suitable means.

Though a well production system is shown in FIGS. 1 and 2 and is described in detail herein, it should be borne in mind that the specific production arrangement set forth in FIGS. 1 and 2 is not intended to limit the spirit and scope of the present invention. Other well system arrangements will also be practical from the features that are set forth herein. Thus, the present invention is not intended to be limited to the well production system that is shown in the drawings, but rather is intended to encompass any well system employing one or more lateral passages that project into a surrounding earth formation from a primary wellbore.

The lateral passages extending from the wellbore may be un-lined or some or all of the lateral passages may be lined with a flexible slotted or otherwise perforated liner as shown at 48 and 50 in the lateral passages forming the array of FIG. 1. The perforated liners serve to stabilize the formation at the lateral passages and the perforations permit transfer of an injection fluid medium to the formation and permit collection of production fluid migrating through the formation to the production lateral passages.

In cases where the subsurface production formation requires support to minimize the potential for sloughing of the formation material into the drilled or jetted lateral passages, formation supporting liners are inserted into selected lateral passages as discussed in detail in U.S. patent application Ser. No. 11/271,231 which was filed on Nov. 12, 2005 by Henk H. Jelsma and entitled Fluid Injection Stimulated Heavy Oil or Mineral Production System and which is incorporated herein by reference for all purposes. The flexible liners are preferably perforated or slotted to provide for flow of injected fluid from the lateral passages into the production formation or flow production fluid into the lateral passages for production, are moved through the primary wellbore and are inserted into selected lateral passages. The slotted tubular liners are preferably composed of polyvinyl chloride or any one of a number of polymer materials having similar or desirable characteristics. The tubular liners are provided with a multiplicity of flow slots or perforations 52 that are located along substantially the entirety of its length. The slotted formation support liner is of sufficient flexibility to be passed through the principal typically vertically oriented wellbore and to become bent as it is diverted into a selected lateral passage that extends from the wellbore into the formation.

After lateral passages have been formed in the formation such as by a drilling, hydraulic jetting or hydro-blasting operation a jet washing assembly is connected to the leading end of the liner 48 or 50 and a fluid supply conduit is connected in fluid supplying relation with a jet washing head by means of an over-pull release mechanism. The fluid supply conduit is typically formed by flexible tubing that can be run into the well and bend to transition into the lateral passages that extend from the wellbore. The jet washing head is provided with a plurality of hydraulic jet nozzles that are arranged to direct jets of high velocity fluid, such as water, against the formation within the lateral passages. The jet nozzles of the jet washing head may be arranged to develop a reaction force which drives the jet washing head and the liner forwardly from the wellbore and into a lateral passage responsive to the jet reaction that occurs at the jet washing head. After sufficient jet washing has occurred to position the entirety of the formation supporting slotted liner within a lateral passage, a pulling force is applied to the fluid supply conduit, causing the over-pull release mechanism to actuate, releasing the connection of the fluid supply conduit with the jet washing head. When this occurs the fluid supply conduit is simply withdrawn from the slotted liner and is retrieved from the well. This process is repeated until the desired lateral passages have all been provided with formation supporting liners. Thereafter, the liners will prevent sloughing of the formation material into the lateral passages and the slots or perforations of the liner will permit efficient flow of injection fluid into the formation and will permit the flow of production fluid from the formation and into the lateral passages.

As mentioned above, when lateral passages are formed in a subsurface formation, it is difficult to ensure precise orientation of each lateral passage of an array of multiple lateral passages. Since in present day practice each lateral passage is typically formed individually, there is often significant angular deviation from the desired orientation of certain passages. Thus, when a production formation is small or when a primary well has been drilled close to an edge of the formation, an error of lateral passage orientation can determine the productivity of the well. It is desired therefore to provide a method and apparatus for multiple lateral passage formation from a primary wellbore wherein multiple lateral passages can be precisely angularly oriented according to a desired plan. It is also desirable to provide a lateral passage forming tool system having an indexing capability thus permitting at least a portion of the tool system to be initially oriented and set according to a desired azimuth and permitting precise indexing of the tool between lateral passage forming operations so that each of the lateral passages of the resulting array of lateral passages is precisely oriented according to the desired plan.

Figure 4:
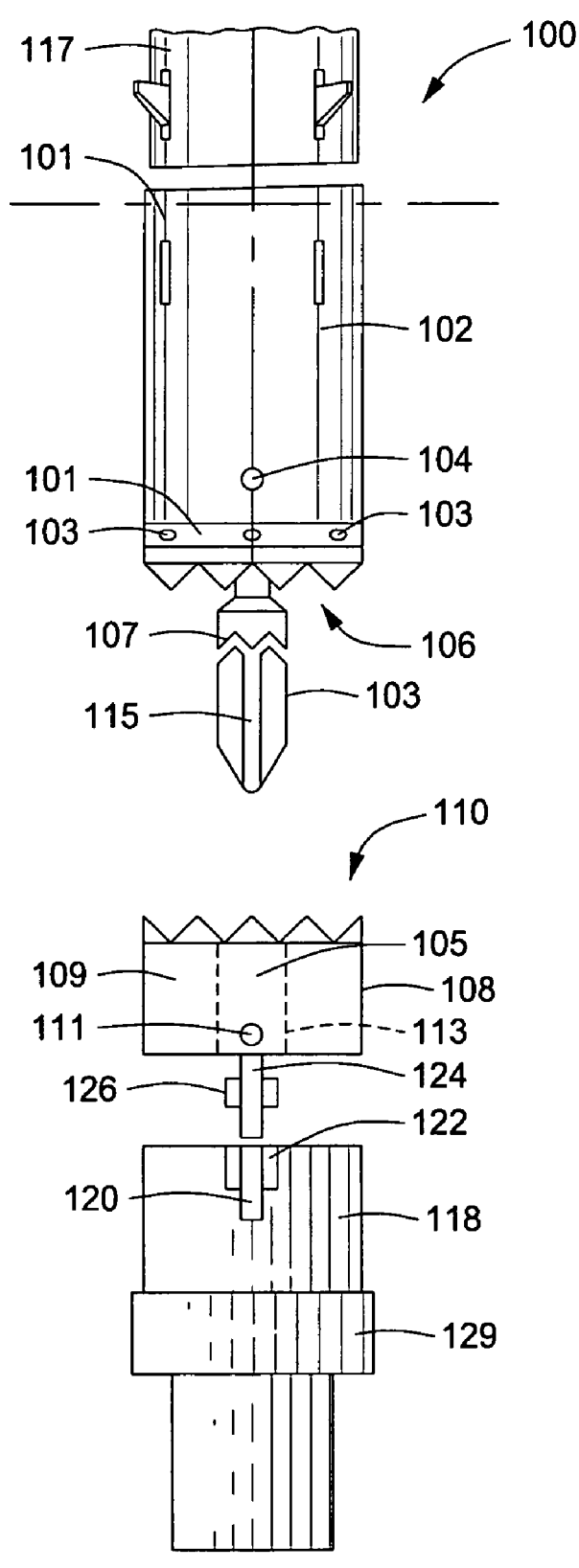
Figure 5:
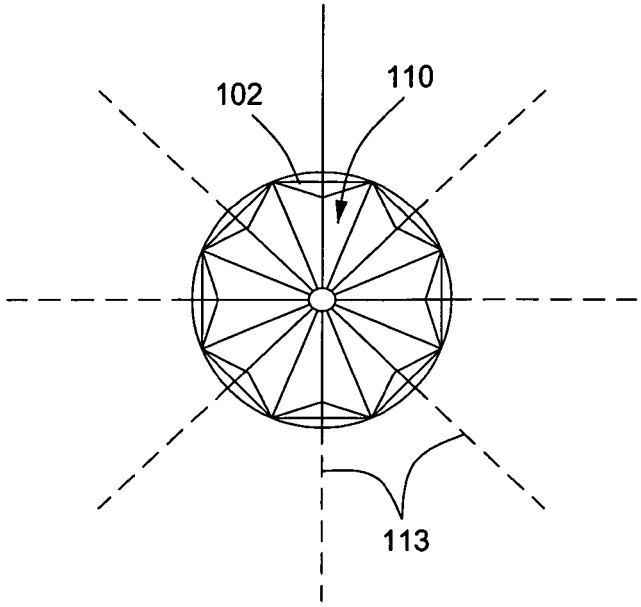

Referring now to FIGS. 3-5 the exploded elevational views show an indexing tool or mechanism generally at 60 having an indexing deflector body 62 that has an exit opening 64 providing for exit of a cutting bit for cutting openings or windows in the casing and also providing for exit of a lateral bore jetting assembly. The embodiment of the invention shown in FIG. 3 is arranged for setting of the tool assembly at the bottom of a well; however it should be borne in mind that the tool assembly may be set within a casing, using a packer for tool positioning and restraint as shown in FIG. 4. At the upper portion of the indexing deflector body 62 there is provided a connector section 66 which provides for direct connection of the indexing deflector body to a drill string, production string or wire-line tool. The indexing deflector body 62 is also provided with a plurality of latch openings 68 which are adapted to receive respective pivotally mounted spring urged latch dogs 69 that project from a tubing connector 71 that represents a cross-over from the indexing mechanism 60 to a tubing or drill string or wire-line system that is employed to achieve location and orientation of the indexing deflector body of the indexing mechanism within the well. The tubing connector 71 is typically connected to a tubing string or drill string for handling and is of sufficiently small diameter that it is receivable within the cylindrical indexing deflector body 62. As the tubing connector enters the indexing deflector body the latch dogs 69 will be pivotally moved to retracted positions. When the latch openings 68 are encountered the latch dogs will be moved outwardly by spring force, thus extending through the latch openings and assuming latching positions. The latch dogs define upwardly facing shoulders 73 that permit the tubing connector 71 to apply a pulling force to the indexing deflector body 62 for retrieving the indexing deflector body from the well or to provide for support of the indexing mechanism within the well. It should be borne in mind that the latch dogs may be moved to retracted and latching positions by mechanical actuation rather than spring actuation if desired.

At the lower portion of the indexing deflector body 62 there is provided an orienting profile or array of orienting teeth shown generally at 70 and having an orienting geometry of any suitable form. For purposes of explanation the setting or orienting array is shown to be of annular form and is shown to have a plurality of sharply defined setting teeth 72 arranged in a setting or orienting pattern. For example the setting or orienting array 70 may have four or eight setting or orientating teeth. The setting teeth may have any other suitable geometry that facilitates orientation and indexing control.

A bottom hole setting or orienting tool shown generally at 74 is adapted to be set within a wellbore or casing to provide for support and reference of a well servicing tool rotatably connected therewith. The exploded view illustration of FIG. 3 shows a bottom set version of the tool where the lower end of the tool string rests at the bottom of the wellbore. This version is compared with a packer set version of the tool which is presented in the exploded view FIG. 4 and where one or more packers are expanded within a wellbore or casing to secure the tool at the desired formation depth. With respect to the bottom hole set version shown in FIG. 3, at its upper end the setting or orienting tool is provided with a matching setting or orienting array of teeth shown generally at 76 and having a geometry corresponding to the form or geometry of the setting or orienting array of teeth 70. For purposes of explanation the setting or orienting array of teeth is shown to be of annular form and is shown as having a plurality of setting teeth 78 arranged in a setting or orienting pattern and disposed for interfitting engagement with the setting or orienting teeth 72. The indexing teeth may be of any suitable configuration or geometry that facilitates maintenance of the indexer or indexing deflector body 62 in accurately positioned and non-rotatable relation when the orienting teeth have been positioned in engagement. When positioned apart as shown in FIG. 3 the bottom hole setting tool 74 is substantially immoveable within the wellbore or casing and its orienting teeth 78 establish a plurality of orienting positions for the orienting teeth 72 of the indexing deflector body. Typically the indexing deflector body is capable of assuming four positions at rotational increments of 90°; however the indexing deflector body may have more or less rotational positions if desired. The indexing deflector body 62 is provided with the capability for infinite 360° relative rotational positioning within the wellbore or casing, thus providing for infinite rotational adjustment of the position of the tool exit opening 64. This feature permits selective directional orientation of one or more casing openings and lateral passages as may be warranted by the condition of the subsurface formation or the location of the primary wellbore with respect to a boundary or other subsurface anomaly of the formation. To accomplish this feature the indexing deflector body 62 defines a rotational adjustment section 63 having at least one and preferably a plurality of locking members 65 which may conveniently take the form of set screws, locking bolts or the like. Thus, the deflector tool 62 is infinitely rotatably adjustable along an adjustment joint or connection 85 thus causing the deflector tool 62 to be selectively rotationally adjusted for precise rotational positioning of the tool exit opening 64 relative to the annular array 70 of indexing teeth 78. Thus the deflector tool 60 is capable of being rotationally positioned as desired, such as with respect to a selected azimuth as determined by the substantially fixed position of the indexing teeth 78 of the bottom indexing tool 74. The extension pipe 82 and the setting bit are employed when the indexing tool is intended to be set at the bottom of the wellbore. This feature of infinite adjustability of the upper array of indexing teeth 72 permits a casing opening forming tool or a lateral passage forming tool to be precisely rotationally oriented with respect to a selected azimuth and/or the position of the bottom indexing tool to form casing openings and lateral passages that are precisely oriented with respect to a subsurface lateral passage design. And when rotationally positioned as desired, the set screws or other suitable retainers 65 are installed and/or tightened to secure the rotationally adjustable section and the upper array of indexing teeth of the indexing mechanism in immoveable or locked relation with the indexing deflector body.

The setting bit 80 and its extendable steel pipe 82 are generally referred to collectively as a stab tool. The bottom indexing tool 74 is provided with a cross-over and supporting mount projection 84 to the stab tool. The extendable steel pipe 82 is typically mounted to the cross-over and supporting mount projection 84 by a suitable threaded connection although other suitable means of connection may also be employed. A centralizer assembly 86 is mounted to the cross-over stab tool and serves to centralize the setting tool and cross-over stab tool within a wellbore or casing.

The multiple setting tool 60 has an indexing deflector body 62 that is provided within a centrally or axially oriented guide receptacle 88 in the form of a centrally located passage. Within the axially oriented guide receptacle 88 is located a guide lug 89 which is fixed to the bottom setting tool 74 and projects into the guide receptacle. The indexing deflector body 62 is provided with a downwardly projecting indexing control stinger 90 which is adapted to enter the centrally or axially oriented guide receptacle 88 and establish accurate alignment of the indexing deflector body 62 with the bottom setting tool 74 and thus also establish accurate alignment or registry of the oppositely facing annular arrays of indexing teeth 72 and 78. The downwardly projecting indexing control stinger 90 is also adapted, by means of an indexing slot, to accomplish incremental indexing rotation of the indexer deflecting tool body 62 as is discussed in detail herein in connection with FIG. 8. The guide lug 89 is located at a selected azimuth by positioning and setting of the bottom setting and indexing tool 74 and establishes rotational orientation of the indexer deflecting body 62 and during increments of upward and downward movement of the indexing control stinger 90 reacts with the indexing slot of the indexing control stinger to achieve increments of rotational indexing of the indexer deflecting body.

The bottom setting tool 74 is also provided with an internal latch dog receptacle 92 that is adapted to receive the latch dogs of a running and retrieval tool, not shown, which extends downwardly from a connector of the running and retrieving tool. The running and retrieving tool is connected to a tubing string, drill string or to a wire-line tool which is used for setting and retrieval of the bottom or lower setting and indexing tool 74. The latch dogs of the running or retrieval tool are either spring urged or mechanically actuated to ensure latching activity when the latch dogs enter the latch receptacle 92.

As explained above, the oppositely facing annular arrays of indexing teeth 72 and 78 will become disengaged when the indexing deflector body 62 and its indexing control stinger 90 are moved upwardly relative to the bottom setting tool 74 thus permitting rotation of the indexing deflector body 62 to one of the rotational indexing positions that is desired for orienting the exit opening 64 for cutting a casing opening or forming a lateral passage within the formation. Downward movement of the indexing deflector body 62 and its indexing control stinger 90 will cause the oppositely facing annular arrays of indexing teeth to move into indexing engagement, thus preventing rotation of indexing deflecting tool relative to the bottom setting tool 74. At the engaged positions of the oppositely facing annular arrays of indexing teeth the bottom setting tool will maintain its static position within the wellbore or casing and in relation with a desired azimuth with which it was aligned when set.

For setting and retrieval of the bottom setting tool or indexing mechanism a running, setting and retrieval tool is connected with the bottom setting or indexing mechanism 74 such as by engaging within the latch receptacle 92. The running, setting and retrieval tool, with the indexing mechanism in releasable assembly therewith, is run into the well to an intended depth for supporting engagement with the bottom of the wellbore and is set either by engaging the bottom of the wellbore or by supporting it within the wellbore or casing by means of a packer, such as is shown in FIG. 4. When a guide or connector shaft of a running, setting and retrieval tool is fully seated within the guide receptacle 88 the latch dogs of the tool will move or be moved to their latched positions, thereby securing the setting tool 74 in releasable accurately oriented position within the well.

As shown in FIG. 4 a packer set indexing mechanism representing an alternative embodiment of the present invention is illustrated generally at 100 wherein an indexer deflector tool body 102 is shown to provide an exit opening 104 from which a casing opening forming bit or a lateral bore jetting assembly is moved to form a casing opening be a cutting operation or to form a lateral bore into the surrounding formation by means of a jetting or boring operation. By selective rotational positioning of the indexing deflector body 102 within a wellbore or casing a plurality of casing openings may be formed and a plurality of lateral bores may be formed in the surrounding formation from a primary wellbore during a single run of a tool for each operation. For example a desired number of casing openings may be made by running a casing cutting tool into the well and by rotational indexing of the casing cutting tool between each cutting operation. Likewise, a desired number of lateral bores or passages may be formed in the surrounding formation by locating a bore or passage forming tool in registry with a previously formed casing opening and by running a jetting or boring tool through the opening and to a desired distance into the formation. The lateral bore or passage forming tool is then rotationally indexed to registry with another previously formed casing opening and the process is repeated until all of the lateral bores or passages have been formed. Thus, by conducting multiple downhole operations during a single run of each of several tools, significant time and cost savings are realized in preparation of a well for enhanced productivity.

If desired the multiple deflector tool body 102 may be provided with an adjustment section 101 to permit infinite rotational adjustment of the adjustment section with respect to the multiple deflector tool. Locking members 103, which may take the form of one or more set screws or locking screws or bolts, are typically provided for securing the position of the adjustment section with respect to the indexer deflector tool 102.

The arrays of indexing teeth, as is evident from FIGS. 4 and 5 is shown to be defined by annular arrays of sharply defined teeth that are of generally triangular form and have triangular shaped grooves between the teeth. Alternatively, the indexing profile may be formed by tooth and groove forms of generally rectangular cross-sectional configuration of smoothly contoured tooth and groove forms. A bottom setting indexing tool 108 is shown to be in spaced relation with the multiple deflector tool 102 and is provided with an upwardly facing annular array of indexing or orienting teeth 110 that correspond to the configuration of the downwardly facing array of indexing or orienting teeth 106. The rotational adjustment section 109, which may have a thread connection or any other type of rotatable connection with the body of the setting tool 108, permits infinite rotational adjustment from a portion of 1° to 360° to provide for infinite adjustment of the rotational positioning of a well service tool with respect to the indexing profile of the annular array of indexing or orienting teeth 110. Directional lines 113 are shown in FIG. 5, to indicate the various angles of subsurface lateral passage orientation that are possible when the teeth 106 of the indexing deflector body and 110 of the bottom setting indexing tool 108 are of the character shown. Obviously, the geometry and number of the array of orienting teeth will determine the number and orientation of the lateral passages that can be formed when the indexing tool is used. Typically each indexing array of teeth or indexing profiles will have a desired number of indexing teeth in its annular pattern or array, thus permitting a desired number of indexing positions for 360° relative rotation of the indexing deflector body and bottom indexing setting tool components.

An indexing control stinger 103 extends in downwardly projecting relation from the indexing deflector body 102 and is positioned centrally of the annular array of indexing teeth 106. The indexing control stinger 103 is adapted to enter a corresponding internal guide receptacle or passage of the bottom setting indexing tool as shown in broken line at 105 to establish a precisely oriented relation of the setting tool and the indexing deflector body and the arrays of indexing teeth thereof. The indexing control stinger 103 is provided with an indexing slot having an indexing control profile 107. When the indexing deflector body is run into the well to approximately the depth of lateral bore fonnation the indexing control stinger will enter the guide receptacle 105 and the lower tapered end of the indexing control stinger will come into contact with a guide lug 111 which is fixed to the bottom setting indexing tool 108 and projects into a centrally oriented receptacle 113 of the bottom setting indexing tool 108. Only when the indexing control stinger 103 is properly rotationally oriented relative to the guide lug will the guide lug enter the longitudinal portion 115 of the indexing control profile of the indexing control stinger, thus permitting the opposed arrays of indexing teeth to move toward engagement. As the indexing deflector body is raised and lowered with respect to the setting tool, the indexing control profile causes incremental rotational movement of the indexer deflector tool in a predetermined direction for incremental rotational positioning of a the indexer deflector tool. The indexing control profile may have a geometry that establishes four rotationally indexed positions of the well service tool at 90° increments of rotation so that the well service tool is enabled to conduct operations forming four precisely oriented casing openings and lateral passages. By changing the indexing control stinger 103 for another indexing control stinger having a different rotary indexing control profile, the number and orientation of casing openings and lateral passages formed by the lateral passage forming tool during a single run and multiple sequential lateral passage forming operation may be changed as desired.

When the downwardly and upwardly arrays of indexing teeth are in spaced relation as shown in FIGS. 3 and 4 the multiple deflector tool 102 and the setting tool 108 are subjected to relative rotation for selective adjustment of the angular position of the passage forming tool with respect to the exit opening 104. By adjusting the angular position of the lateral passage forming tool with respect to the exit opening each lateral passage will be selectively oriented with respect to a selected azimuth. This feature permits the azimuth of each of the downhole lateral passages of a production formation to be simply and efficiently controlled by adjusting the position of the exit opening of the indexer deflector tool 102 with respect to the bottom setting indexing tool 108. It should be borne in mind that the bottom setting indexing tool 108 may have any suitable character or system of orientation that enables it to be accurately aligned with respect to either magnetic north or true north or that is capable of being adjustably set with respect to any mechanical, electrical or magnetic reference or by any suitable well logging system.

The bottom setting indexing tool 108 is provided with a lower section 118 having an internal orienting receptacle 120 having an orienting slot 122. The bottom setting indexing tool 108 is provided with a downwardly projecting orienting member 124 and a transverse orienting member 126. These orienting members engage within the orienting receptacle and orienting slot to establish precision rotational alignment of the bottom setting orienting tool 108 and its indexing teeth 110 with respect to the bottom, packer support section of the tool. A packer 129 is mounted to the lower, packer support section 118 of the bottom setting indexing tool and serves to provide for setting of the indexing mechanism within a casing or within an open-hole wellbore as desired. Alternatively, the indexing mechanism may be provided with a setting bit as shown at 80 and a bit supporting extension as shown at 82 in FIG. 3 in the event it is desired to set the indexing mechanism in relation to the bottom of a wellbore. A tubing connector 117 similar to that shown at 71 in FIG. 3 is used to run and retrieve the indexer diverter tool 102 and functions in the same manner as discussed above in connection with FIG. 3. Any other suitable running and retrieving tool may also be used to position and set the tool components and to cause selective indexing of the indexer diverter tool 102 to predetermined indexed positions for conducting specific downhole operations such as casing opening forming and lateral passage forming.

Figure 6:
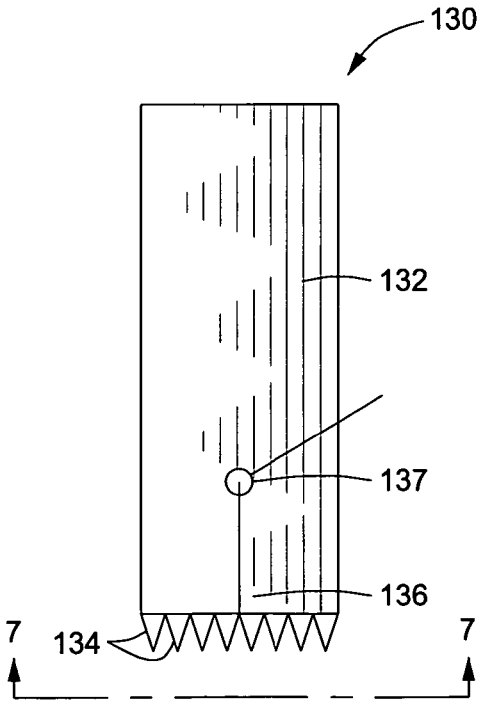
Figure 7:
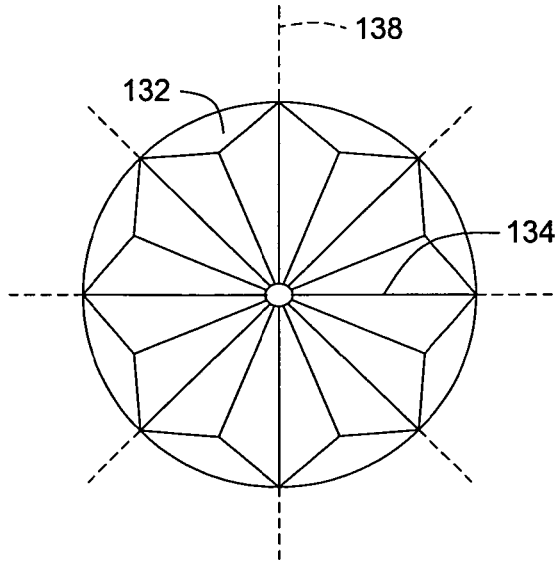

Referring now to FIGS. 6 and 7 an indexing mechanism is shown generally at 130 which comprises a multiple deflector tool 132 having an circular array of downwardly facing indexing teeth 134. The deflector tool has an indexing deflector body that defines a reference marker or indexing point 136 for selective positioning and defines an exit opening 137 from which well service tools such as a casing opening forming tool or a jetting head or rotary bit are extended. The reference marker or indexing point 136 of the indexing deflector body 132 is shown to be in the form of an alignment arrow and is aligned with respect to a setting tool by means of one or more alignment keys. The indexing tooth profile of the downwardly facing array of indexing teeth is shown at 134 in the plan view of FIG. 7 and evidenced by the broken lines 138 of FIG. 7 identify eight possible index or orientation positions for subsurface lateral passage formation as it engages the corresponding upwardly facing setting or orienting array of indexing teeth of the bottom setting or orienting tool. Obviously, the user of the indexing mechanism and lateral passage forming tool may also choose to form four lateral passages in a subsurface formation by sequential lateral passage forming operations if desired, each being oriented at angles of 90°. Also, if desired the user of the lateral passage forming tool and indexing mechanism has the capability of forming a single selectively oriented lateral passage from a well or forming any desired number of selectively oriented lateral passages, from one passage to eight passages as desired.

Referring now to the partial elevational view of FIG. 8 and the flat layout view of FIG. 9, it is desirable to provide a rotational indexing system for selectively achieving known rotational indexing movement of a casing opening cutting or forming tool and a lateral passage forming tool simply by causing upward and downward cycles of incremental movement of the indexing deflector body by a tool actuating string or a wire line tool handling system. As shown in FIGS. 8 and 9 a four position indexing system is shown for enabling the formation of four casing openings and lateral passages that extend from the casing openings or the wellbore and into a subsurface formation. It should be borne in mind, however, that similar indexing mechanisms may be provided within the spirit and scope of the present invention for use in generating a lesser or greater number of casing openings and lateral passages if desired. Also, it should be borne in mind that the position of the setting tool may be linearly adjusted by increments of linear movement so that casing openings and/or lateral passages may be selectively located along a selected length of the wellbore wall or may be grouped at selected intervals or depths with respect to the subsurface formation of interest.

FIG. 8 illustrates the downwardly projecting indexing control stinger 90 of the indexing tool system of FIG. 3 and shows the indexing control stinger 90 as having a rotary or indexing or orienting mechanism generally at 140. The indexing control stinger 90 is provided with a single external longitudinal guide slot 142 which is open at the lower tapered end 144 of the indexing control stinger 90 thus defining a guide slot entry opening 146. At least one guide member, such as a guide lug 148 projects from the setting indexing tool 74 into the guide receptacle or passage 88 of a bottom setting indexing tool 74 and is positioned to be received within the external longitudinal guide slot 142 when the indexing control stinger 90 is properly rotationally aligned with the structure of the bottom setting indexing tool 74. The bottom setting indexing tool is oriented within the well so that the guide lug 148 is precisely oriented with respect to the wellbore and the formation intersected by the wellbore. The position of the bottom setting indexing tool is determinative of each of the indexed positions of the indexing deflector tool and thus controls the orientation of all of the casing openings lateral bores that are formed. Upon rotational alignment of the longitudinal slot 142 of the indexing control stinger with the guide lug 148, the indexing control stinger and thus the indexing deflector body 62 is moved downwardly to move the downwardly facing upper annular array of indexing teeth toward indexing or positioning engagement with the upwardly facing lower annular arry of indexing teeth. The indexing control stinger 90 is moved downwardly until the guide lug 148 enters the longitudinal guide slot 142 of the multiposition rotary indexing mechanism 140. During this downward movement of the indexing control stinger and indexing deflector body the guide lug, being in engagement within the longitudinal guide slot 142 will maintain the relative rotational positions of the indexing deflector body and the setting tool 74, thus permitting the indexing teeth of the opposed indexing arrays to be brought into precisely controlled indexing engagement. The bottom setting indexing or orienting tool 74 at this point will have been actuated to its set or fixed condition within the wellbhore or well casing and thus will be secured against both linear and rotational movement within the wellbore or casing.

Upon the guide lug 148 reaching the first angulated section 156 of the multiposition circumferential rotary indexing slot 150 as the result of downward movement of the indexing control stinger 90, the guide lug will encounter a "Y" intersection 149. A first guide lug control member 152 will prevent the guide lug from moving upwardly and to the left as shown in FIG. 8 as indicated by the word "NO" and a second guide lug control member 154 will permit movement of the guide lug 148 upwardly and to the right as indicated by the word "YES", causing the guide lug to proceed in unidirectionally controlled manner through an angulated section 156 of the rotary indexing slot geometry to an apex 158 as is indicated by a movement arrow. Travel of the guide lug through the inclined section 156 of the rotary indexing slot caused by downward movement of the indexing control stinger 90 relative to the guide lug 148 of the fixed or set bottom setting tool will cause the indexing control stinger to rotate 45° during an increment of its vertical movement. When the guide lug is seated at either of the apexes 158 of the circumferential rotary indexing slot, the circular arrays of indexing teeth will have become engaged to lock the sections of the indexing mechanism against inadvertent relative rotation. During this increment of downward movement of the indexing control stinger the guide lug will react with an angulated side or edge 155 of the rotary indexing slot section 156 causing incremental rotational movement of the indexing setting diverter tool 62. Preferably the angulated sections of the rotary indexing slot geometry are inclined at 45° for a four position rotational indexing system achieving 45° rotational movement of the setting tool during the downward increment of indexing control stinger movement and another increment of 45° rotational movement of the setting tool during a subsequent increment of upward movement of the indexing control stinger. 90° of rotational movement of the setting tool is thus achieved during each cycle of downward and upward movement of the depending indexing control stinger 90 relative to the fixed position of the bottom setting indexing tool 74. It should be borne in mind, however, that any other suitable angles of inclination of the rotary indexing slot may be employed when different increments of rotational movement of a downhole well tool are desired, without departing from the spirit and scope of the present invention.

When upward movement of the indexing control stinger 90 occurs from the apex position 158 due to controlled lifting of the indexing deflector body 62, an edge or guide shoulder of the succeeding rotary indexing slot section 160, reacting with the guide lug 148, will cause the rotatable indexing diverter tool to be moved through another increment of 45° rotational movement that is determined by the geometry of the rotary indexing slot. The rotational movement of the indexing control stinger 90 is unidirectional since rotational control members prevent movement of the indexing control stinger in the opposite rotational direction. In the case of a four position indexing system as shown in FIGS. 8 and 9, this increment of rotational movement will be 45°. Thus, the two increments of rotational movement that occur during each cycle of downward and upward movement of the indexing control stinger within the guide rotational indexing movement of the indexing diverter tool, thus positioning the exit opening of the indexing diverter tool 62 exactly 90° from its previous rotational position. When the rotary indexing slot geometry defines four apexes 158 on the circumference of the indexing control stinger 90 as is evident from FIG. 8 and from the flat layout view of FIG. 9, that each upward and downward cycle of indexing control stinger movement that occurs when the indexing deflector body 62 and its indexing control stinger 90 are lifted and lowered, will cause the setting tool to be rotated by an increment of precisely 90°. Thus, a casing opening forming tool or a lateral passage forming tool supported by the rotatable component of the setting tool will have four indexed operative positions each rotationally spaced at increments of 90°. When the guide lug has engaged within the one of the apexes 158 the indexing control stinger will have moved downwardly to its maximum extent and the arrays of indexing teeth will be seated in rotation preventing engagement. At this point the tool for forming casing openings or the tool for lateral passage formation, whichever is in assembly with the rotational component of the setting tool of the indexing mechanism, will be precisely positioned for its well service operation. A single well service tool being projected from the exit opening of the indexing diverter tool can be used repeatedly to form all of the casing openings or to form all of the lateral passages during a single run of the tool system. This multiple service activity capability significantly minimizes the trips of tools servicing a well and thereby minimized the time and cost requirements for completing the well servicing activity.

After a particular well servicing operation has been completed at a selected indexed position of the indexing mechanism it is desirable to index the well service tool to successive rotational positions and to repeat the well servicing operation at each position. The rotary indexing slot geometry 150 permits rotation of the well service tool to a successive preselected indexed position simply by raising and lowering the indexing deflector body and thus the indexing control stinger 90 through a cycle of indexing movement. From an apex 158 of the rotary indexing slot downward movement of the guide lug within the rotary indexing slot, caused by upward movement of the indexing control stinger results in movement of the guide lug within a succeeding oppositely angulated section 160 of the rotary indexing slot, since a locking element 162 functions to prevent return of the guide lug through the inclined rotary indexing slot section 156 and functions to permit movement of the guide lug through the succeeding oppositely inclined section 160 of the rotary indexing slot geometry. Thus, the indexing control stinger 90 causes the setting tool 74 with its upwardly facing annular array 76 of indexing teeth 78 to be rotated through a desired angle of rotation as determined by the geometry of the rotary indexing slot. Preferably a four position rotary indexing slot will have eight angulated sections and four apexes for each complete rotation of 360° and thus for each cycle of upward and downward movement of the indexing control stinger, the setting tool will be rotated through an angle of 90°. This feature permits four equally angled lateral passages to be formed by a lateral passage forming tool that is positioned by the indexing mechanism. However it should be borne in mind that two, three or more equally angled casing openings and lateral passages may be formed simply by providing a indexing control stinger having rotary indexing slot geometry that accomplishes desired rotational positioning of a well service tool.

Unidirectional progression of the guide lug 148 in the directions of the movement arrows through the multiple angulated sections of the circumferential rotary indexing slot geometry of the indexing control stinger 90 is controlled by a plurality of lug movement control members. The first of these lug movement control members is shown at 152 and is urged to a lug blocking position by a spring 153. The spring will yield to permit guide lug movement of the lug movement from the rotary indexing slot section 151 to the Y-position 149 at the intersection of the longitudinal guide passage 142 with the rotary indexing slot geometry after completion of indexing movement through all of the indexing positions of the rotary indexing slot. The second of these lug movement control members is shown at 154 and is moveably maintained at a control position by a spring member 157. The various angulated sections of the rotary indexing slot geometry each have similar lug movement control members so that four downward and upward cycles of movement of the indexing control stinger will achieve 360° of rotational indexing movement of the well service tool that is supported and oriented by the setting tool 74. After the guide lug has progressed unidirectionally through all of the indexed positions of the rotary indexing slot, the next increment of lifting movement of the indexing deflector body will return the guide lug to a position of registry with the longitudinal guide slot 142. At this point the indexing deflector body may be retrieved form the will, leaving the setting or orienting tool 74 in place for controlling precise rotational orientation of other tools for subsequent well servicing operations.

The present invention is practiced according to the following method: An indexing tool having the capability for rotational indexing and having upper and lower sections each defining annular arrays of indexing teeth or other indexing geometry is run into a well and its lower setting or orienting section is set at the bottom of the wellbore or set on a packer within the casing of the well. If desired the indexing mechanism may also incorporated a linear indexing mechanism such as is shown in FIG. 8 thus permitting the tool assembly to have the capability for linear indexing adjustment as well rotational indexing. This feature permits lateral passage design where the passages may extend radially from the well and into the formation and also may be spaced along the length of a selected section of the wellbore or casing.

When an indexing mechanism is set within the well it is initially precisely aligned with a particular reference azimuth, thus permitting each of the lateral passages to be formed in the subsurface formation with respect to the selected azimuth of reference. This feature is accomplished by loosening the connection of the rotational adjustment section 81, such as by loosening retainer screws or bolts 83 and by manually positioning the adjustment section relative to the orienting reference point 64. This character of adjustment is infinite and permits any rotational position within a rotational adjustment range of 360° to be selected. After precision rotational adjustment has been accomplished the retainer screws or bolts are then tightened to lock the adjustment mechanism at the desired position.

With the indexing mechanism located within the well and the setting tool set with respect to the wellbore or casing a first well service operation is carried out. Assuming that the well service operation is the formation of openings or windows in the casing and formation of lateral passages from the wellbore into the surrounding formation of interest or the formation of lateral passages from an open hole wellbore, the first operation will be carried out by an appropriate tool. After that tool has completed its first well service operation, the deflector housing is lifted to separate the annular arrays of indexing teeth and to initiate a cycle of linear movement. The rotary indexing slot and guide lug arrangement will interact to cause an increment of rotational movement of a well service tool during lifting movement of the deflector housing and a second increment of rotational movement of the well service tool during lowering of the deflector housing. When the indexing mechanism is provided with a indexing control stinger 90 having a four position rotary indexing slot geometry as shown in FIGS. 9 and 10 each cycle of lifting and lowering of the indexing deflector body will achieve 90° of rotational movement of the well service tool that is connected thereto. After each such cycle of lifting and lowering movement of the deflector housing a successive well service operation can be carried out without any requirement to remove the well service tool from the well between each well service operation. For example, a well service operation for cutting or forming casing openings or windows mmay be performed by a specific casing tool. After having completed the formation of a casing opening the tool is retracted to an inoperative position within the casing and the indexing mechanism is cycled downwardly and upwardly, thus indexing the casing tool to its next operating position. This activity is repeated until the casing tool has completed all of its operations. The indexing deflector body is then retrieved from the well, leaving the setting tool at its oriented position if desired. Another well service tool, such as a lateral passage forming tool is then connected to the setting tool and the indexing deflector body is run into the well for rotational orientation control of the well service tool. This process is repeated until all of the lateral passages of the well have been formed, after which the indexing mechanism and setting tool are retrieved from the well and the well is then prepared for production.

A window opening cutting and/or lateral passage forming tool or any other well service tool is controllably connected with the lower section of the indexing mechanism so as to be positionable via controlled rotational indexing actuation. If the well has a casing, which is the condition that is usually encountered, a window or opening cutting tool will be supported and oriented by the lower setting tool section of the indexing mechanism. The opening forming or cutting mechanism is then actuated to form an accurately positioned opening or window in the casing. This procedure is repeated a desired number of times, with the tool being indexed either rotationally, linearly or both for precision location of all of the casing openings that are desired. It is important to note that this opening forming procedure for all of the desired casing opening is accomplished by running the tool into the well one time and by retrieving the tool from the well after all of the desired casing openings have been formed. If the well is an "open hole" well, without a casing or if a section of the casing has been removed at the depth of the production formation, then use of an opening or window forming tool is not necessary.

When the casing openings or windows have been formed or when the well is otherwise ready for lateral passage formation, a passage forming tool is then run into the well with a string of tubing, typically referred to as a "stinger" and is landed on and latched to the upper section or deflector body of the indexing mechanism. This causes the lateral passage forming tool to be precisely oriented by the indexing mechanism in relation to the azimuth of reference. The lateral passages are then formed using a commercially available hydromotor type drilling system, a hydro-blaster type passage forming tool or a tool of any other suitable character. After each lateral passage has been formed, the indexing mechanism is actuated for a predetermined increment of rotation indexing movement, linear movement or both simply by lowering and lifting the indexing deflector body and achieving rotational positioning by means of the rotary indexing slot geometry followed by engagement of the annular arrays of indexing teeth to lock the indexing mechanism at the selected indexed position. This procedure is repeated until all of the lateral passages have been formed in the subsurface formation. It is important to note that all or a desired number of lateral passages are formed during a single run of the passage forming tool, after which the tool is retrieved from the well. This "single-run" passage forming procedure significantly minimizes the rig time and thus the costs for completing the well with a desired number of precisely located lateral passages and provides a simple and efficient system for lateral passage formation providing assurance that the lateral passages are precisely located according to a designed plan.

In the event the subsurface formation is not well consolidated and there is a potential for sloughing of formation material into the lateral passages, flexible slotted or otherwise perforated liners 48 and 50 can be run through the guide passage and into the lateral passages utilizing a washing head and define slots or openings 52 through which fluid is permitted to flow. These slotted liners are typically composed of polyvinyl chloride or any other polymer material having similar characteristics and are sufficiently flexible to pass through the lower transitioning curvature of the guide passage.

After all of the lateral passages have been formed in the subsurface formation, the indexing mechanism and passage forming tool are removed from the well to complete the lateral passage forming operation. At this point it may be appropriate to provide one or more tieback conduits to make individual connection with certain ones of the lateral passages. If so, the indexing mechanism and passage forming tool will also function to guide the tieback connectors from the wellbore and into the desired lateral passages.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for sequentially forming multiple lateral passages extending into a subsurface formation from a well and each being oriented along an independent azimuth from the well; comprising:

running a lateral passage forming tool having a rotary indexing mechanism connected therewith into the well, said indexing mechanism having a first indexing component having a guide receptacle and a guide member projecting within said guide receptacle and a second indexing component defining a circumferential multiposition rotary indexing slot having a plurality of indexing sections;

orienting one of said first and second indexing components such that said multiposition rotary indexing slot is positioned to receive said guide member in guided relation therewith;

achieving relative linear and rotational movement of said first and second indexing components and causing said guide member to engage a first indexing section of said rotary indexing slot and become seated at a first indexing position;

conducting a first of a plurality of lateral passage forming operations;

sequentially repeating said relative linear and rotation movement of said first and second indexing components and sequentially conducting succeeding lateral passage forming operations; and after completion of a predetermined number of sequential lateral passage forming operations, retrieving said lateral passage forming tool and said indexing mechanism from the well.

2. The method of claim 1, comprising:

said achieving relative linear and rotation movement of said first and second indexing components being a lifting movement of said first indexing component causing rotary indexing slot interaction with said guide member to achieve a first increment of rotational movement of said second indexing component and lowering movement of said first indexing component causing rotary indexing slot interaction with said guide member to achieve a second increment of rotational movement of said second indexing component.

3. The method of claim 1, wherein said guide member is fixed to a rotatable well tool positioning member and said rotary indexing slot is formed circumferentially on an indexing control stinger and has a plurality of indexing sections each having first and second oppositely inclined slot sections defining a slot apex at the intersection thereof, said method comprising:

moving said indexing control stinger linearly in a first direction and causing said rotary indexing slot to cause linear and rotational indexing movement of said guide member and a well service tool mounted thereto until said guide member becomes engaged within a slot apex of one of said plurality of indexing sections and the well service tool is rotationally indexed to a first well service position;

conducting a well service operation; and after completion of the lateral passage forming operation, moving said indexing control stinger linearly in a second direction causing rotary indexing slot actuation of said guide member and well service tool to an intermediate position and again moving said indexing control stinger linearly in said first direction causing rotary indexing slot actuation of said guide member and well service tool to a succeeding rotationally indexed position.

4. The method of claim 1, wherein said guide member is fixed to a rotatable well tool positioning member and said rotary indexing slot is formed circumferentially on a indexing control stinger and has a plurality of indexing sections each having first and second oppositely inclined slot sections defining a slot apex at the intersection thereof, said method comprising:

moving said guide downwardly causing to cause linear and rotational indexing movement of said guide member and a well service tool mounted thereto by said rotary indexing slot until said guide member becomes engaged within a slot apex of one of said plurality of indexing sections and the well service tool is rotationally indexed to a first well service position;

conducting a well service operation; and after completion of the well service operation moving said indexing control stinger upwardly causing rotary indexing slot actuation of said guide member and well service tool to an intermediate rotational position and again moving said indexing control stinger downwardly causing rotary indexing slot actuation of said guide member and well service tool to a succeeding rotationally indexed well service position.

5. The method of claim 1, wherein each of said first and second indexing components defines an array of indexing teeth, said method comprising:

during relative rotational movement of said first and second indexing components to an indexing position, moving said arrays of indexing teeth into indexed engagement.

6. A method for running a lateral passage forming tool having a rotary indexing mechanism connected therewith into a well and sequentially forming multiple lateral passages extending into a subsurface formation from the well the multiple lateral passages each being oriented along predetermined azimuths, comprising:

positioning a rotary indexing mechanism and lateral passage forming tool within a well, the indexing mechanism having rotary indexing connection with the lateral passage forming tool and being set to a predetermined azimuth;

actuating the lateral passage forming tool and forming a first lateral passage in the subsurface formation;

after completion of the first lateral passage actuating the indexing mechanism to move the lateral passage forming tool to a second lateral passage forming position;

actuating the lateral passage forming tool and forming a second lateral passage in the subsurface formation from the well, the second lateral passage being oriented along a second azimuth;

sequentially repeating said steps of forming a lateral passage and actuating the indexing mechanism until a desired number of lateral passages have been formed in the subsurface formation from the well each lateral passage extending from the well along an independent azimuth; and after sequentially forming the lateral passages retrieving the indexing mechanism and lateral passage forming tool from the well.

7. The method of claim 6, comprising:

said positioning an indexing mechanism being orienting a first portion of the indexing mechanism with respect to a selected azimuth and in substantially fixed relation within the well;

positioning a second portion of said indexing mechanism in rotationally restrained indexed relation with said first portion; and causing linear cycling movement of said second portion of said indexing mechanism and rotationally indexing said second portion to predetermined rotationally indexed positions.

8. The method of claim 6, comprising:

said indexing step being rotational indexing movement of the indexing mechanism and rotational indexing movement of the lateral passage forming tool.

9. The method of claim 6 wherein an indexing deflector body is provided with a downwardly facing upper array of indexing teeth and a bottom indexing tool is releasably positioned in fixed relation within the well, said method comprising:

said indexing step being selective infinite rotational adjustment of said upper array of indexing teeth of said indexing mechanism prior to running said indexing mechanism into the well, causing precise orientation of the lateral passage forming tool with respect to said bottom indexing tool.

10. The method of claim 6 wherein an indexing mechanism is provided and has two indexing sections each having indexing teeth being engageable for maintaining an indexed position and being relatively rotatable to predetermined rotationally indexed positions, said method comprising;

moving said two indexing sections linearly apart sufficiently to disengage said indexing teeth;

causing relative unidirectional rotation of one of said two sections to sequential indexing positions; and linearly moving said two indexing sections into positions engaging said indexing teeth and restraining relative rotation of said two sections of said indexing mechanism.

11. An indexing mechanism for sequentially controlled positioning of a device within a well, comprising:

first and second indexing members being positionable within a well, said second indexing member establishing a substantially immoveable and selectively oriented position at desired depth within the well;

said first indexing member being linearly and rotationally moveable relative to said substantially immoveable second indexing member and having positioning connection with the device and being sequentially rotationally indexed to a plurality of pre-determined positions by selective rotational positioning of said first indexing member relative to said second indexing member:

said second indexing member defining a guide receptacle;

a guide member being in substantially fixed relation with said second indexing member and being located within said guide receptacle;

an indexing control stinger fixed to and projecting downwardly from said first indexing member and being receivable in linearly and rotationally guided relation within said guide receptacle; and a multiposition rotary indexing slot being defined by said indexing control stinger and receiving said guide member in position controlling relation therein and having rotationally indexing slot geometry positioned for engagement by said guide member, said indexing control stinger being moveable linearly by said first indexing member and during said linear movement engaging said rotary indexing slot geometry and imparting incremental rotational movement to said first indexing member and to the device connected therewith.

12. The indexing mechanism of claim 11, comprising said first indexing member having a first indexing profile;

said second indexing member having a second indexing profile;

said first and second indexing members establishing indexing engagement preventing rotational movement of said first indexing member relative to said second indexing member and being separable to permit rotational movement of said first indexing member relative to said second indexing member; and said first indexing member having positioning connection with the device and being sequentially rotationally indexed to a plurality of pre-determined rotationally indexed positions by selective rotational positioning of said first indexing member with respect to said second indexing member.

13. The indexing mechanism of claim 12, comprising:

said first and second indexing profiles being opposed arrays of indexing teeth being separable to permit relative rotation of said first and second indexing members and engaging to restrain rotation of said first rotation of said first indexing member relative to said second indexing member.

14. The indexing mechanism of claim 11, comprising:

said multiposition indexing slot having a longitudinal guide slot;

a rotational movement slot having intersection with said longitudinal guide slot and extending circumferentially of said indexing control stinger, said rotational movement slot having a plurality of rotation imparting sections each having opposite inclined slot sections intersecting at an apex; and said guide member sequentially traversing said plurality of rotation imparting sections responsive to reciprocating linear movement of said indexing control stinger by said first indexing member and imparting unidirectional increments of rotational movement to said first indexing member.

15. An indexing mechanism for controlled rotational positioning of a downhole tool within a well, comprising:

first and second indexing members being positionable within a well, said second indexing member establishing a substantially immoveable and selectively rotationally oriented position at desired depth within the well;

rotary indexing profiles being defined on said first and second indexing members and engaging to prevent relative rotation of said first and second indexing members and separating to permit rotation of said first indexing member relative to said second indexing member;

said first indexing member having positioning connection with the downhole tool and being sequentially rotationally indexed to a plurality of pre-determined positions by selective rotational positioning of said first indexing member relative to said second indexing member:

said second indexing member defining a guide receptacle;

a guide member being in substantially fixed relation with said second indexing member and being located within said guide receptacle;

an indexing control stinger being fixed to and projecting downwardly from said first indexing member and being receivable in linearly and rotationally guided relation within said guide receptacle of said second rotary indexing member; and a multiposition indexing slot being defined by said indexing control stinger and having a rotary indexing geometry, said multiposition indexing slot receiving said guide member in position controlling relation therein, said indexing control stinger being moveable linearly by said first indexing member and during said linear movement said guide member reacting with said rotary indexing geometry and imparting incremental rotational movement to said first indexing member and to the downhole tool connected therewith.

16. The indexing mechanism of claim 15, comprising:

said indexing profiles being annular arrays of indexing teeth defined respectively on said first and second indexing members and being arranged and spaced to permit incremental rotational positioning of said first indexing member relative to said second indexing member and thus incremental rotational positioning of a well tool positioned by indexing rotation of said first indexing member relative to said second indexing member.

17. The indexing mechanism of claim 15, comprising:

said rotational indexing profiles each being annular arrays of indexing teeth preventing rotation of said first indexing member relative to said second indexing members when in engagement and when separated permitting rotation of said first indexing member relative to said second indexing member;

a rotational adjustment section being provided on one of said first and second indexing members and supporting one of said annular arrays of indexing teeth, said rotational adjustment section being infinitely rotationally adjustable and achieving infinite rotational adjustment of said one of said annular arrays of indexing teeth; and at least one locking member securing said rotational adjustment section at any selected position of rotational adjustment.

18. The indexing mechanism of claim 15, comprising: said multiposition indexing slot having a longitudinal guide slot;

a rotational movement slot being defined by said indexing control stinger and having intersection with said longitudinal guide slot and extending circumferentially of said indexing control stinger, said rotational movement slot having a plurality of rotation imparting sections each having apposite inclined slot sections intersecting at an apex; and said guide member sequentially traversing said plurality of rotation imparting sections responsive to reciprocating linear movement of said indexing control stinger by said first indexing member and imparting unidirectional increments of rotational movement to said first indexing member relative to said second indexing member.

19. The indexing mechanism of claim 18, comprising:

rotation control members being movably positioned on said indexing control stinger and being located adjacent said rotational movement slot, said rotation control members permitting unidirectional movement of said guide member through said rotational movement slot.

* * * * *